US011400320B2

(12) United States Patent
Xu

(10) Patent No.: US 11,400,320 B2
(45) Date of Patent: Aug. 2, 2022

(54) MULTIFUNCTIONAL SAFETY TOOL

(71) Applicant: Ye Xu, Sugar Land, TX (US)

(72) Inventor: Ye Xu, Sugar Land, TX (US)

( * ) Notice: Subject to any disclaimer, the term of this patent is extended or adjusted under 35 U.S.C. 154(b) by 316 days.

(21) Appl. No.: 16/521,871

(22) Filed: Jul. 25, 2019

(65) Prior Publication Data

US 2021/0023399 A1 Jan. 28, 2021

(51) Int. Cl.
*A62B 3/00* (2006.01)
*F41B 15/00* (2006.01)

(52) U.S. Cl.
CPC ..... *A62B 3/00* (2013.01); *A62B 3/005* (2013.01); *F41B 15/00* (2013.01)

(58) Field of Classification Search
CPC ..... A62B 3/00; A62B 3/005; A01D 75/008; A45F 5/021; A45F 2200/0575; A45F 2200/0566; B25F 1/006; B60R 22/32; B60R 2022/328; B26F 1/00
USPC ..... 7/144, 145, 158, 170; 30/123, 280, 294, 30/366
See application file for complete search history.

(56) References Cited

U.S. PATENT DOCUMENTS 3,130,884 A * 4/1964 Lintz ..... A62B 3/005 225/93
9,840,226 B2 * 12/2017 Faughn ..... B60R 22/12
2013/0256349 A1 * 10/2013 Styth ..... B25H 3/00 224/271
2018/0257205 A1 * 9/2018 Wood ..... B25B 15/005

* cited by examiner

*Primary Examiner* — Tyrone V Hall, Jr.
(74) *Attorney, Agent, or Firm* — Benjamin Aaron Adler

(57) ABSTRACT

Provided herein are personal safety tools and multifunctional safety tool. The tools have a window striker and a tactical whip on each end of a grip or handgrip. Alternatively, the window striker includes a blade to enable a user to cut through a seat belt. The tool is useful for extricating one's self or another from a vehicle and/or for defending one's self or another from an attacker in an emergency.

13 Claims, 11 Drawing Sheets

MULTIFUNCTIONAL SAFETY TOOL

BACKGROUND OF THE INVENTION

Field of the Invention

The present invention relates to the fields of personal safety devices and vehicle safety accessories. More specifically, the present invention relates to a multipurpose tool useful for escaping from a vehicle and for personal defense.

Description of the Related Art

Currently, safety equipment such as safety hammers capable of breaking a vehicle's window are commonly installed on vehicles, such as busses, which carry a large number of passengers for use in emergency situations. Smaller vehicles including cars do not have pre-installed safety hammers. Consequently, car owners would need to separately purchase safety hammers, which are usually placed in the car's tool box, storage box or similar locations.

Unfortunately, not having appropriate safety equipment within arm's reach inside a vehicle is a disadvantage if it is difficult to quickly pick up the safety equipment and use it in case of a life-threatening emergency. Furthermore, proper functioning of a safety hammer is compromised if the tool is not correctly positioned to strike and break the window. Moreover, existing vehicle-mounted safety hammers are inconvenient to use and have a low impact force, leading to uncertainties in their effectiveness in emergency situations. This may be problematic especially for people with limited strength.

Tactical whips are weapons that complement a repertoire of non-lethal self defense tools that include pepper sprays, tactical pens, stun guns. Tactical whips are easy to train and use even for people with limited strength. Moreover, they may be carried discreetly and deployed very quickly to dissuade and/or injure a potential attacker.

Presently there are no combination tools available for the general public in life-threatening circumstances such as kidnapping and carjacking. There is therefore a recognized need in the art for a user-friendly self-defense and car safety combination weapon that is capable of delivering not only predictable impact force sufficient to break the windows and cut the seat belts, but also effect sufficient bodily injury to discourage an assailant.

The prior art is deficient in these multifunctional safety tools. The present invention fulfills this long-standing need and desire in the art.

SUMMARY OF THE INVENTION

The present invention is directed to a personal safety tool. The tool comprises a tool body with a collar formed at a proximal end thereof and an opening at a distal end forming a receiving space therein. A window striker with a striking tip at a proximal end thereof is formed at the collar on the tool body. A lash with a proximal end thereof is secured within the receiving space at the distal end of the tool body.

The present invention is directed to a related personal safety tool further comprising a clip removably clipped around the collar on the tool body. The present invention is directed to another related personal safety tool further comprising a plurality of finger grips disposed on an outer surface of the tool body. The present invention is directed to yet another related personal safety tool further comprising a flexible casing disposed around the lash. The present invention is directed to yet another related personal safety tool further comprising a strap receiving opening disposed through the window striker.

The present invention also is directed to a multifunctional safety tool. The tool has a substantially cylindrical body comprising a window striker portion formed at a proximal end thereof and a lash securing portion formed at a distal end thereof. A lash is secured to the lash securing portion and blade secured to the window striker portion.

The present invention is directed to a related multifunctional safety tool further comprising a collar formed around the substantially cylindrical body immediately distal to the window striker portion and a clip removably clipped around the collar.

The present invention is directed to another related multifunctional safety tool further comprising a plurality of finger grips disposed on an outer surface of the tool body. The present invention is directed to another related personal safety tool where the lash is about 3 to about 6 flexible strands entwined in a cable form and further comprises a flexible casing disposed around the lash.

Other and further aspects, features, and advantages of the present invention will be apparent from the following description of the presently preferred embodiments of the invention given for the purpose of disclosure.

BRIEF DESCRIPTION OF THE DRAWINGS

So that the matter in which the above-recited features, advantages and objects of the invention, as well as others that will become clear, are attained and can be understood in detail, more particular descriptions of the invention briefly summarized above may be had by reference to certain embodiments thereof that are illustrated in the appended drawings. These drawings form a part of the specification. It is to be noted, however, that the appended drawings illustrate preferred embodiments of the invention and therefore are not to be considered limiting in their scope.

FIG. 2A particularly shows the clip detached from the tool in an exploded view. FIG. 2B is a view of the multifunctional tool showing the clip clipped to or disposed around the tool body.

FIG. 3A shows the blade detached from the striker in an exploded view. FIG. 3B shows the blade secured to the window striker.

FIG. 4A shows the striker tip detached from the striker in an exploded view. FIG. 4B shows the striker tip attached to the striker.

FIG. 5A shows the lash and securing screws detached from the tool body in an exploded view. FIG. 5B is shows the lash inserted into the distal end on the tool body with the securing screws still in an exploded view. FIG. 5C shows the inserted lash secured to the tool body with the screws.

DETAILED DESCRIPTION OF THE INVENTION

Figure 1:
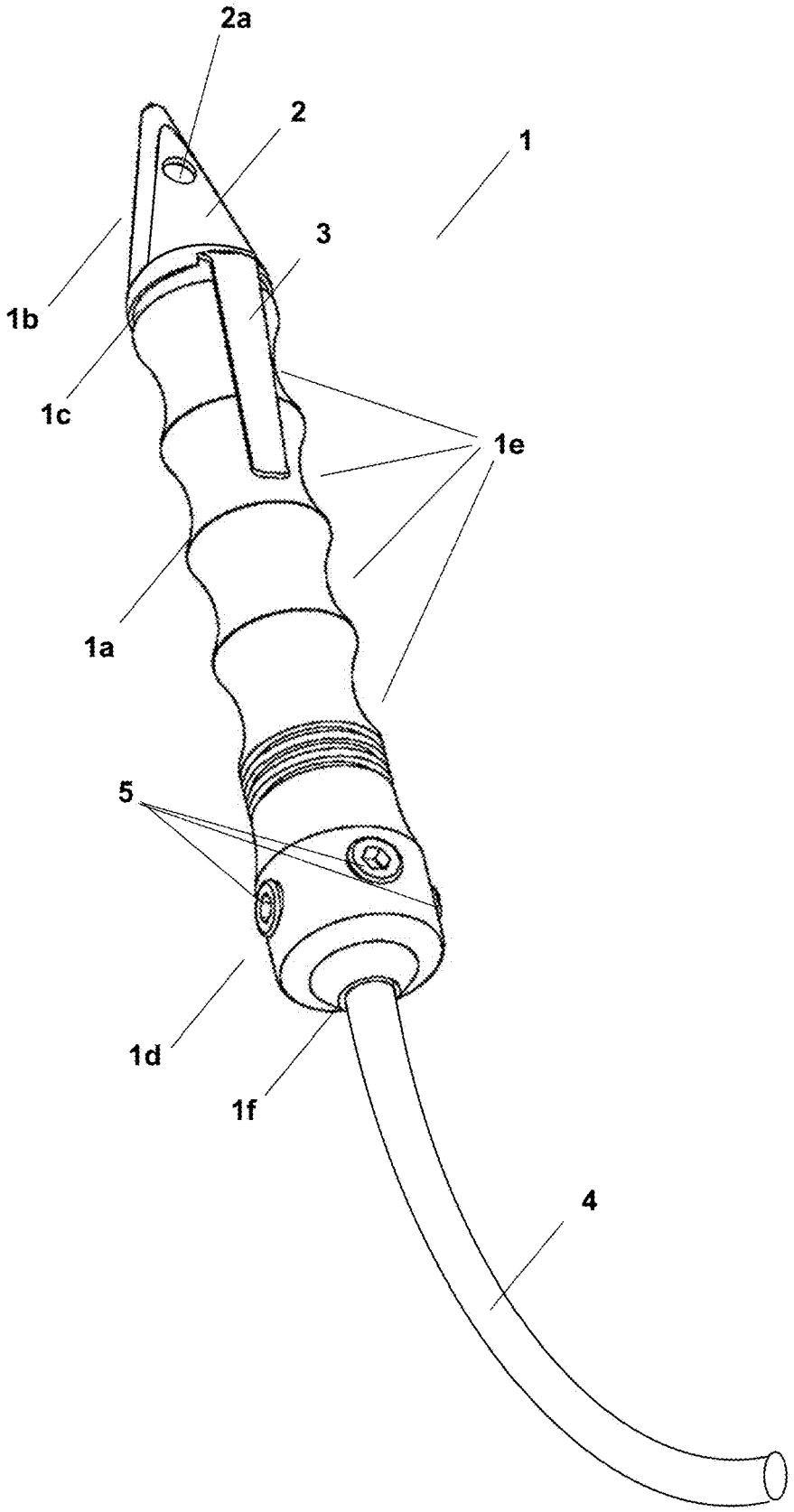
FIG. 1 shows a multifunctional safety tool or personal safety tool with both a tactical whip and a window striker.

As used herein in the specification, "a" or "an" may mean one or more. As used herein in the claim(s), when used in conjunction with the word "comprising", the words "a" or "an" may mean one or more than one.

As used herein "another" or "other" may mean at least a second or more of the same or different claim element or components thereof. Similarly, the word "or" is intended to include "and" unless the context clearly indicates otherwise. "Comprise" means "include."

As used herein, the term "about" refers to a numeric value, including, for example, whole numbers, fractions, and percentages, whether or not explicitly indicated. The term "about" generally refers to a range of numerical values (e.g., +1-5-10% of the recited value) that one of ordinary skill in the art would consider equivalent to the recited value (e.g., having the same function or result). In some instances, the term "about" may include numerical values that are rounded to the nearest significant figure.

As used herein, the terms "multifunctional tool", "multifunctional safety tool", "personal safety tool" and "tool" are interchangeable.

As used herein, the term "tactical whip" refers to a personal safety device or non-lethal weapon comprising a hand grip with a lash or whip-like, flexible cable comprising a plurality of entwined strands attached thereto.

As used herein, the term "proximal" refers to the end of the tool that is at or nearer to the striker tip. Similarly, the term "distal" refers to the end of the tool that is farther away from the striker tip.

In one embodiment of present invention, there is provided a personal safety tool, comprising a tool body with a collar formed at a proximal end thereof and an opening at a distal end forming a receiving space therein; a window striker with a striking tip at a proximal end thereof formed at the collar on the tool body; and a lash with a proximal end thereof secured within the receiving space at the distal end of the tool body.

In a further embodiment, the window striker may comprise a hook-shaped structure formed on an outer surface thereof and further comprises a blade secured within the hook-shaped structure. In another further embodiment the personal safety tool may comprise a clip removably clipped around the collar on the tool body. In yet another further embodiment the personal safety tool may comprise a plurality of finger grips disposed on an outer surface of the tool body. In yet another further embodiment the personal safety tool may comprise a strap receiving opening disposed through the window striker. In yet another further embodiment, the personal safety tool may comprise a flexible casing disposed around the lash.

In all embodiments of the invention, the body may be made of at least one material selected from the group consisting of a plastic, a plastic composite, a metal, a metal alloy, and a metal composite. In all embodiments, the striker tip may be made of a metal or a metal alloy. In addition, the lash may comprise about 3 to about 6 flexible entwined strands formed as a cable. Particularly in the lash the strands each may be made of at least one material selected from the group consisting of a metal, a metal alloy, a metal composite, a plastic, a plastic composite, a leather, and a synthetic leather. In a representative example, each strand is made of steel. Furthermore, the lash may have a length from about 12 inches to about 24 inches.

In another embodiment of the present invention, there is provided multifunctional safety tool, comprising a substantially cylindrical body comprising a window striker portion formed at a proximal end thereof and a lash securing portion formed at a distal end thereof; a lash secured to the lash securing portion; and a blade secured to the window striker portion.

Further to this embodiment the multifunctional safety tool may comprise a collar formed around the substantially cylindrical body immediately distal to the window striker portion and a clip removably clipped around the collar. In another further embodiment, the multifunctional safety tool may comprise a plurality of finger grips disposed on an outer surface of the tool body. In yet another further embodiment, the multifunctional safety tool may comprise a strap receiving opening disposed through the window striker.

In all embodiments, the body may be made of at least one material selected from the group consisting of a plastic, a plastic composite, a metal, a metal alloy, and a metal composite. The window striker portion may comprise a striking tip at a proximal end thereof. Particularly, the striker tip is made of a metal or a metal alloy. In addition, the window striker portion may comprise a hook-shaped structure formed on an outer surface thereof, where the blade is secured within the hook-shaped structure.

In all embodiments, the lash securing portion may comprise a receiving space formed on the distal end thereof such that a proximal end of the lash is received therewithin. The lash may be about 3 to about 6 strands entwined in a cable form and further may comprise a flexible casing disposed around the lash. Particularly, the flexible strands are each made of steel. In addition, the lash may have a length from about 12 inches to about 24 inches.

Provided herein is a personal safety tool and a multifunctional safety tool useful during a vehicular emergency and/or as a self-defense tactical whip. The tool has a tool body with, along the longitudinal axis thereof, a window striker with a striker tip is formed on one end and a tactical whip is formed on the opposite end, both extending along the longitudinal axis of the tool body. Alternatively, the window striker also may have a blade for cutting a seat belt. The tool body may comprise a clip for securing the personal safety tool to a user's garment when not in use.

The tool body may have any suitable shape that enables a user to hold the tool and to strike the window striker against a vehicle window to break it. For example, the tool body may have a cylindrical, cuboidal or oval shape. Particularly, the tool body is substantially cylindrical. The tool body may be made of any material with a high impact strength including, but not limited to, a plastic, a plastic composite, a metal, a metal alloy and a metal composite. Alternatively, a combination of these materials may be used to produce the body. The tool body may be formed with a plurality of finger grips disposed along the outer surface thereof. This provides a handgrip for a user and enables the user to firmly grip the tool body and maintain the grip by curling the fingers around the finger grips when using either the window striker and/or blade or the tactical whip.

The window striker has a transverse opening therethrough to receive a handstrap. The handstrap is utilized for carrying the personal safety tool or for wearing around the wrist to prevent or reduce the likelihood of dropping the tool or losing the tool if threatened or attacked. Such handstraps are well known in the art. The window striker and striker tip independently may be made of any metal or metal alloy having high compressive, tensile, yield and impact strengths. Examples of metals and metal alloys include, but are not limited to titanium, chromium, carbon steel, steel-iron-nickel, stainless steel and titanium alum inide.

When comprising a blade, the window striker has a hook-shaped structure formed on the outer surface thereof.

The blade is secured within by any standard securing means, such as, but not limited to, a screw. An opening is formed between the distal end of the hook-shaped structure and the proximal end of the tool body through which a seat belt strap is slid to be cut by the blade.

The clip may be a removable clip or may be securely fastened to the tool body. In one example, the clip may be a snap on clip that snaps onto or clips snuggly around the tool body. Alternatively, the clip may be attached to the tool body with a securing means, for example, but not limited to, screws. The clip enables a user to discreetly carry the tool, such as by clipping to a garment, with ready access as the user need only pull on or tug the tool for the clip to release from the garment. The clip may be made of any material, including, but not limited to a plastic, a plastic composite, a metal, a metal alloy and a metal composite. Alternatively, a combination of these materials may also be used.

The tactile whip comprises the tool body and a lash secured to the distal end of the tool body and is constructed for non-lethal use. The lash is made of a plurality of flexible strands entwined or twisted together to form a cable. The lash may be secured within the distal end of the tool body by any securing means that does not interfere with a user's ability to grip the tool body and effectively deploy the lash. For example, the distal end of the tool body may comprise a lash receiving space into which a lash end is inserted. A non-limiting securing means is a plurality of securing screws threaded through the outer surface of the distal end of the tool body to secure the lash end inside the receiving space. When threadably engaged with the lash end, the screw heads are even with or flush with the outer surface of the distal end.

The entwined strands may be secured together when entwined by any suitable means that preserves the flexibility of a formed cable structure and of the lash as a whole. A non-limiting example is an adhesive as is known in the art. The strands may be made of any suitable material, such as a material that retains flexibility and integrity when entwined or braided, including, but not limited to, a metal, a metal alloy, a metal composite, a plastic, a plastic composite, a leather and a synthetic leather, or a combination of these. Particularly, the strands forming the cable are made of steel wires.

The number of strands is any number that is sufficient when entwined to produce a desired diameter across a transverse cross-section of the lash. In a non-limiting example, the lash may have about 3 to about 6 strands. Each of the plurality of strands has any suitable length sufficient to enable the user to strike at and, if necessary, to non-lethally injure an attacker from a safe distance of, for example, about an average arms' length. In a non-limiting example, the length of each strand may be about 12 inches to about 24 inches. Particularly, the lash may be about 17 inches.

Alternatively, the lash may comprise a flexible casing covering the entwined strands. The casing may be made of any material suitable to preserve the flexibility and utility of the lash. For example, the casing may be made of a flexible plastic or leather that withstands the force imparted during use.

Particularly, embodiments of the present invention are better illustrated with reference to the Figure(s), however, such reference is not meant to limit the present invention in any fashion. The embodiments and variations described in detail herein are to be interpreted by the appended claims and equivalents thereof.

FIG. 1 illustrates the components and the arrangement thereof of one embodiment of multifunctional safety tool. The tool 1 has a body or tool body 1*a* with a proximal end 1*b* comprising a collar 1*c* formed thereon and a distal end 1*d*. The tool body comprises a grip or handgrip and may have a plurality of finger grips 1*e* disposed thereon.

A window striker or window striker portion 2 is formed from or disposed on the collar. The window striker has striker tip 2*d* (see FIGS. 4A-4B) an opening or strap receiving opening 2*a* disposed therethrough to receive a strap or hand strap (not shown) such as are known in the art and may be looped over the wrist of a user. The combination of the proximal end of the tool with window striker and the handgrip on the tool body comprises tool for a quick escape from a vehicle or quick access into a vehicle by breaking a vehicle window. A clip 3 is secured to or removably clipped onto or around the collar and enables a user to clip the tool to a belt or to a belt loop, a waistband or a pants pocket for easy retrieval.

The distal end 1*d* comprises a lash receiving portion and is structured with an interior lash receiving space 1*g* (see FIG. 3A) to receive through opening 1*f* a lash 4 such as comprises a tactical whip. The inserted lash is secured by a securing means, for example, but not limited to, a plurality of securing screws 5. The combination of the distal end with secured lash and the handgrip on the tool body 1*a* comprises a tactical whip.

Figure 2A:
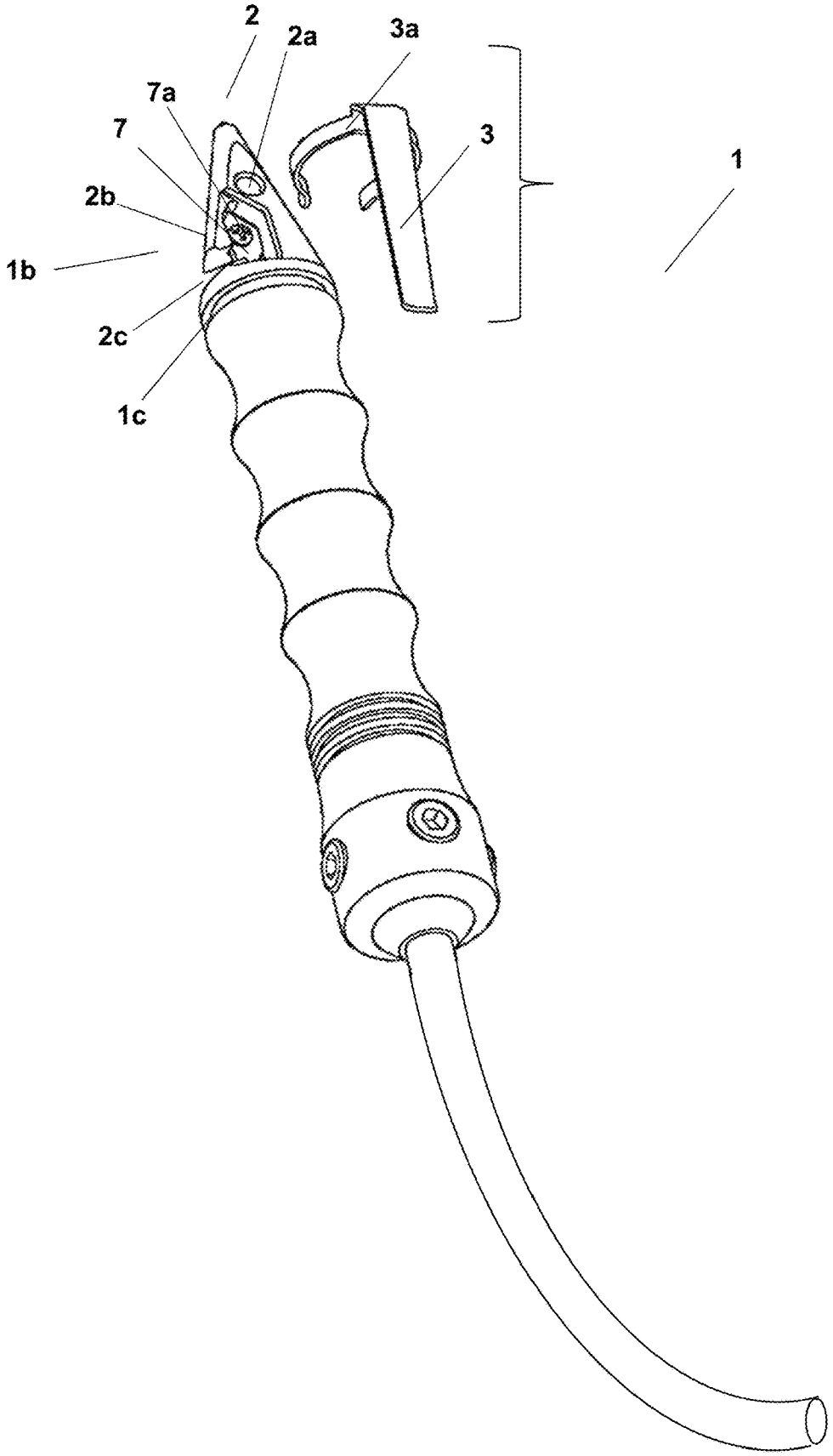
FIGS. 2A-2B are views of a multifunctional safety tool where the window striker comprises a blade to cut a seat belt.

With continued reference to FIG. 1, FIG. 2A illustrates the components and the arrangement thereof of another embodiment of the multifunctional safety tool. The window striker or window striker portion 2 with opening 2*a* on the proximal end 1*b* of the tool 1 comprises a hook-shaped structure 2*b* formed on an outer surface thereof and a blade 7 secured within the hook-shaped structure by a securing means, for example, but not limited to, a screw 7*a*. An opening 2*c* is formed between the distal end of the hook-shaped structure and the collar 1*c* to provide access to the blade. The combination of the hook-shaped structure, which prevents injury to a user from the blade, with the blade enables a user to quickly cut a seat belt to escape from a vehicle. The clip 3 is shown detached from the collar 1*c* to show the clipping end 3*a* which clips onto the collar.

Figure 2B:
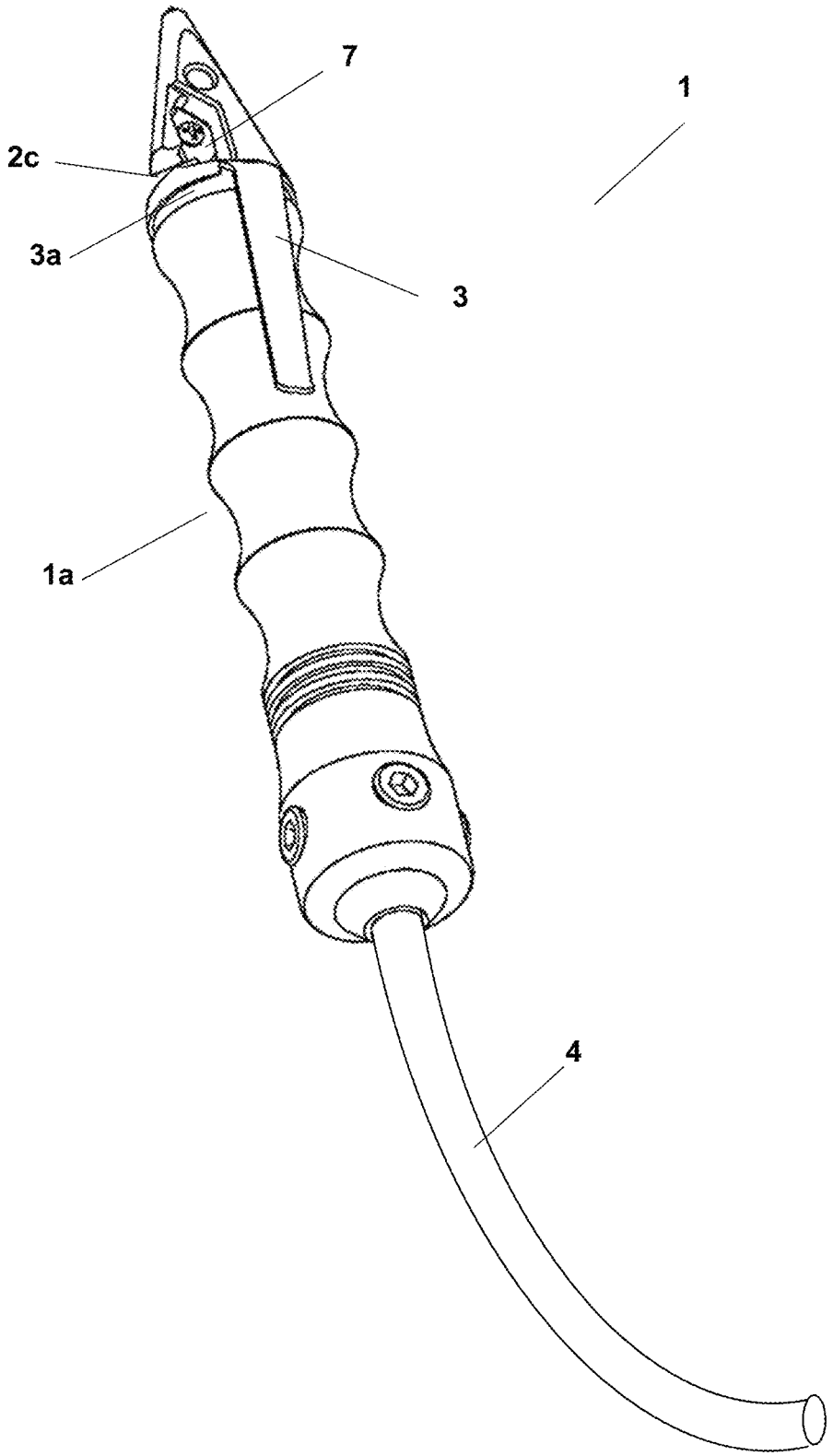

With continued reference to FIG. 2A, FIG. 2B shows the clip 3 with the clipping end 3*a* disposed on or clipped onto the collar without interfering with access through the opening 2*c* to the blade 7. The clip enables a user to removably clip the multifunctional tool onto a belt loop such that the tool body 1*a* and lash 4 extend along the waistband under the belt loops whereby a potential assailant would not be aware that the user is in possession of the tool.

Figure 3A:
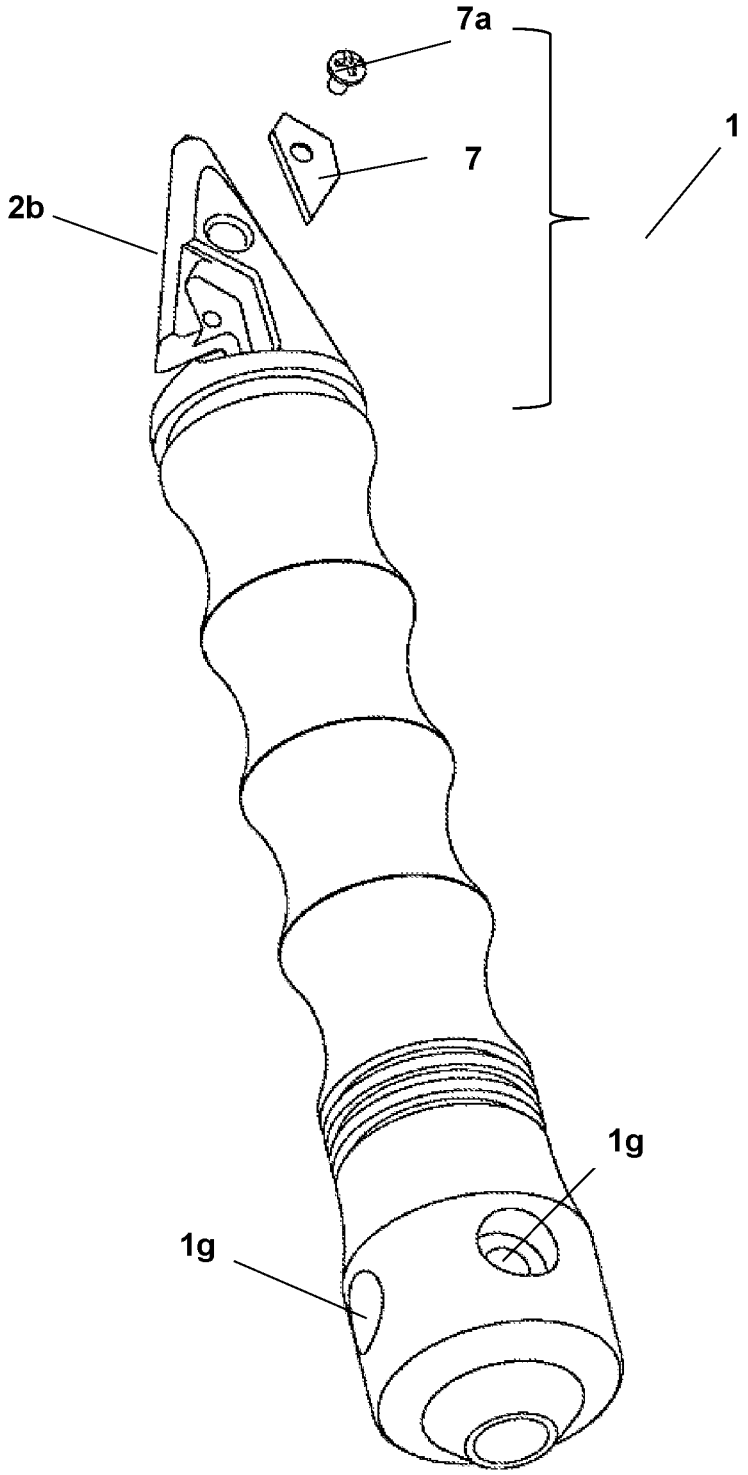
FIGS. 3A-3B are partial views of the multifunctional safety tool in FIGS. 2A-2B.

With continued reference to FIG. 2A, FIG. 3A is a partial view of the multifunctional tool 1 showing an exploded window striker 2. The exploded view shows the hook-shaped structure 2*b* with the blade 7 separated from the hook-shaped structure and the blade securing screw 7*a* separated from the blade to illustrate the positioning and securing of the blade there within. With the lash and lash securing screws removed the interior lash receiving space 1*g* is visible.

Figure 3B:
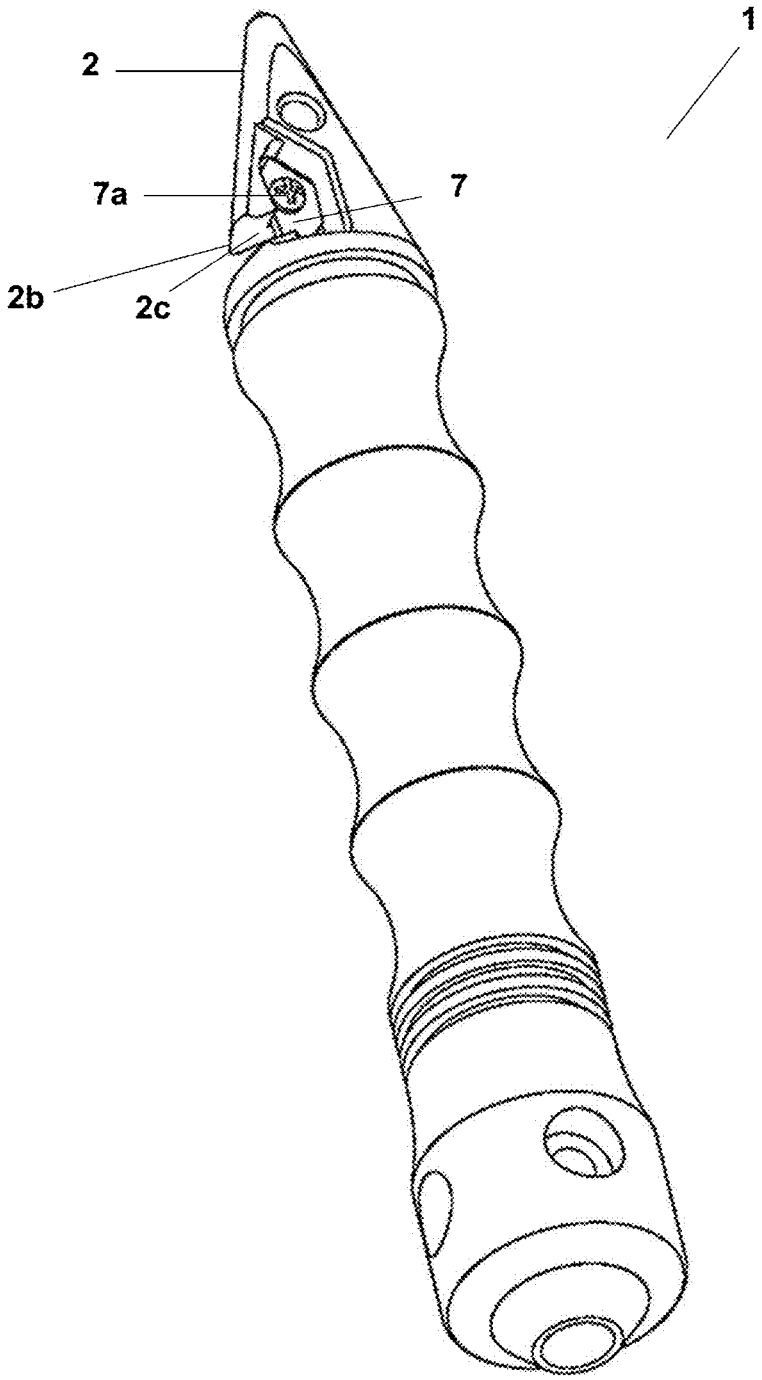

With continued reference to FIG. 3A, FIG. 3B shows the blade 7 attached via the screw 7*a* within the hook-shaped structure 2*b* on the window striker 2. The view illustrates how the opening 2*c* between the distal end of the hook-shaped structure and the collar 1*c* provides access to the blade.

Figure 4A:
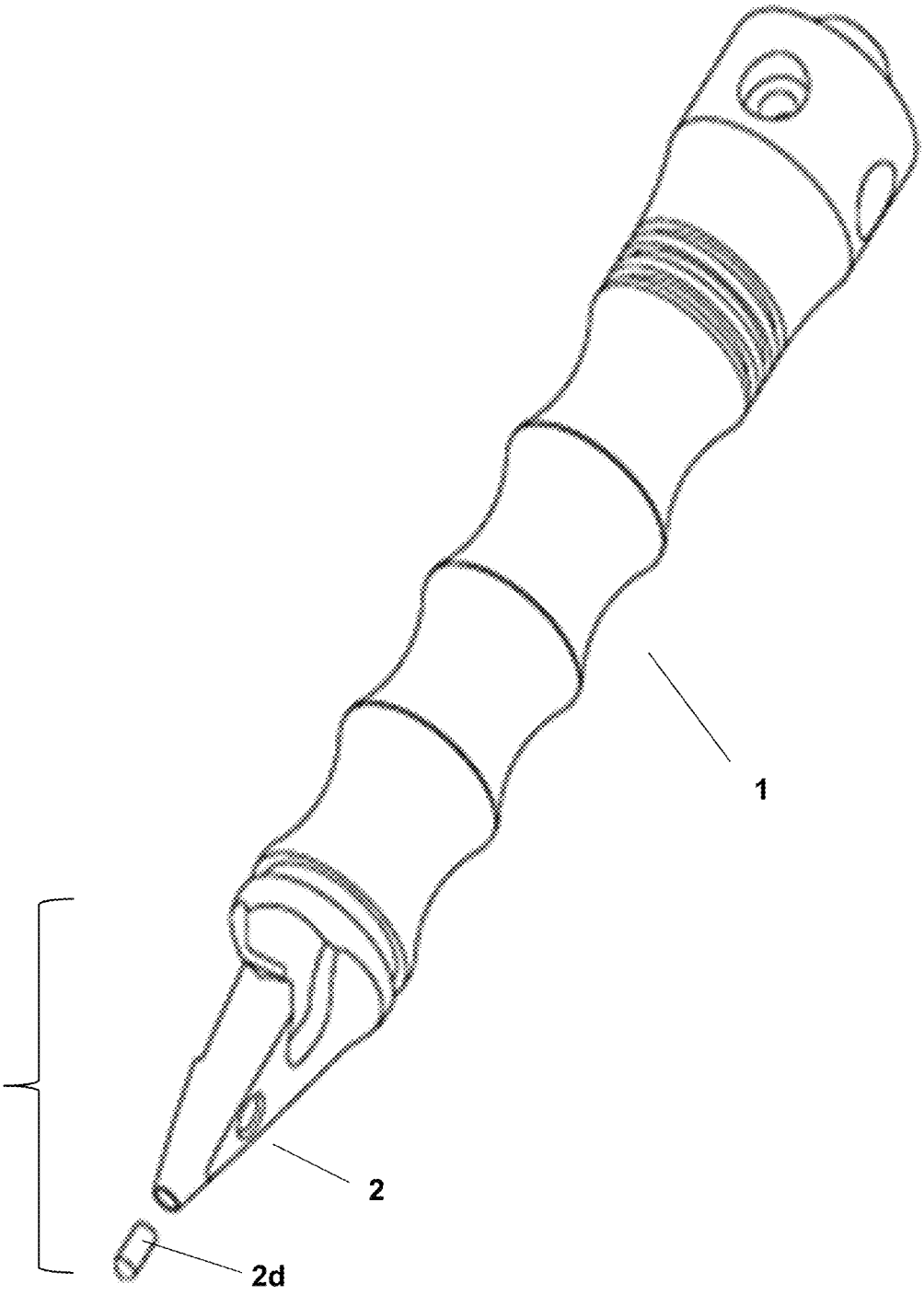
FIGS. 4A-4B are partial views of the multifunctional safety tool in FIGS. 2A-2B.

With continued reference to FIGS. 2A and 2B, FIG. 4A is a partial view of the multifunctional tool 1 showing the striking tip 2*d* detached from the proximal end of the window striker 2.

Figure 4B:
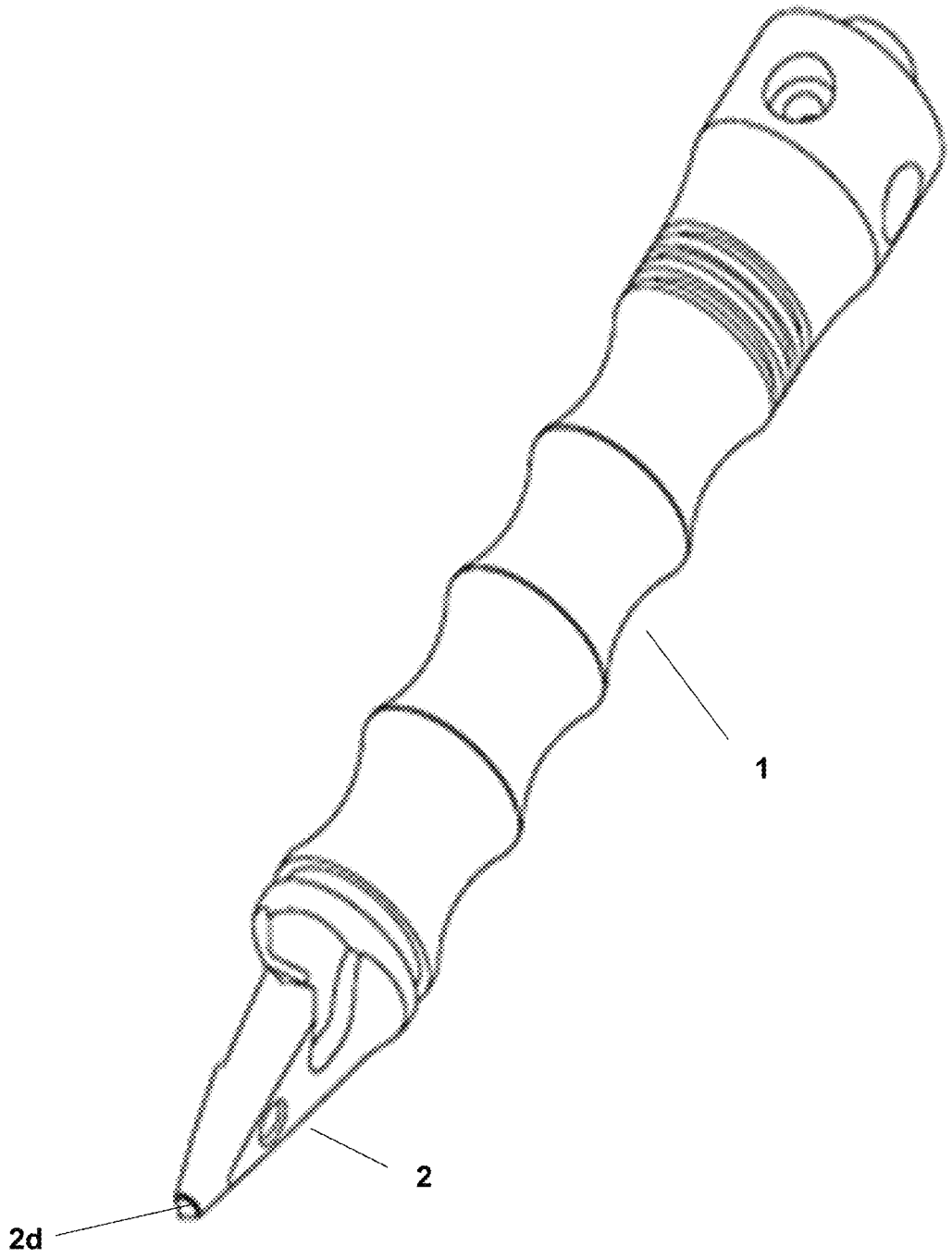

With continued reference to FIG. 4A, FIG. 4B shows the striker tip 2*d* inserted or disposed within the proximal end on the window striker 2. The striker tip is made of a material sufficiently hard, for example, but not limited to, hardened steel, that enables a user to break a window glass in a vehicle to escape from or to assist someone in escaping from a vehicle in case of an emergency.

Figure 5A:
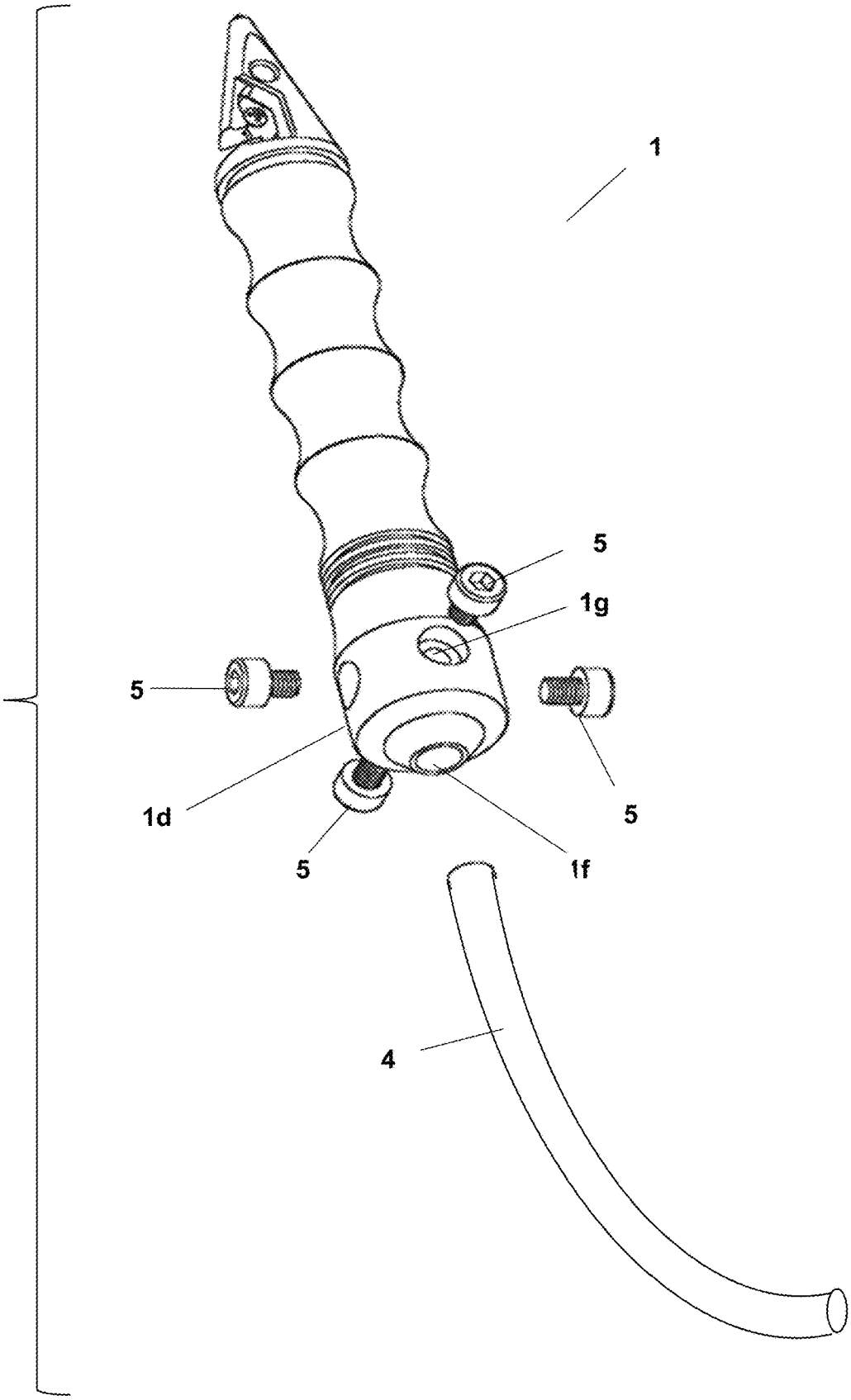
FIGS. 5A-5C illustrate attachment of the lash on the tactical whip to the tool body.

With continued reference to FIGS. 2A, 2B, 3A and 3B, FIGS. 5A-5C illustrate the assembly of the lash within the lash receiving space 1*g* within the distal end 1*d* of the multifunctional tool 1. FIG. 5A shows the distal end 1*d* of the tool in an exploded view with the plurality of screws 5 and the lash 4 removed. Both the opening 1*f* in the distal end and the interior lash receiving space 1*g* are shown.

Figure 5B:
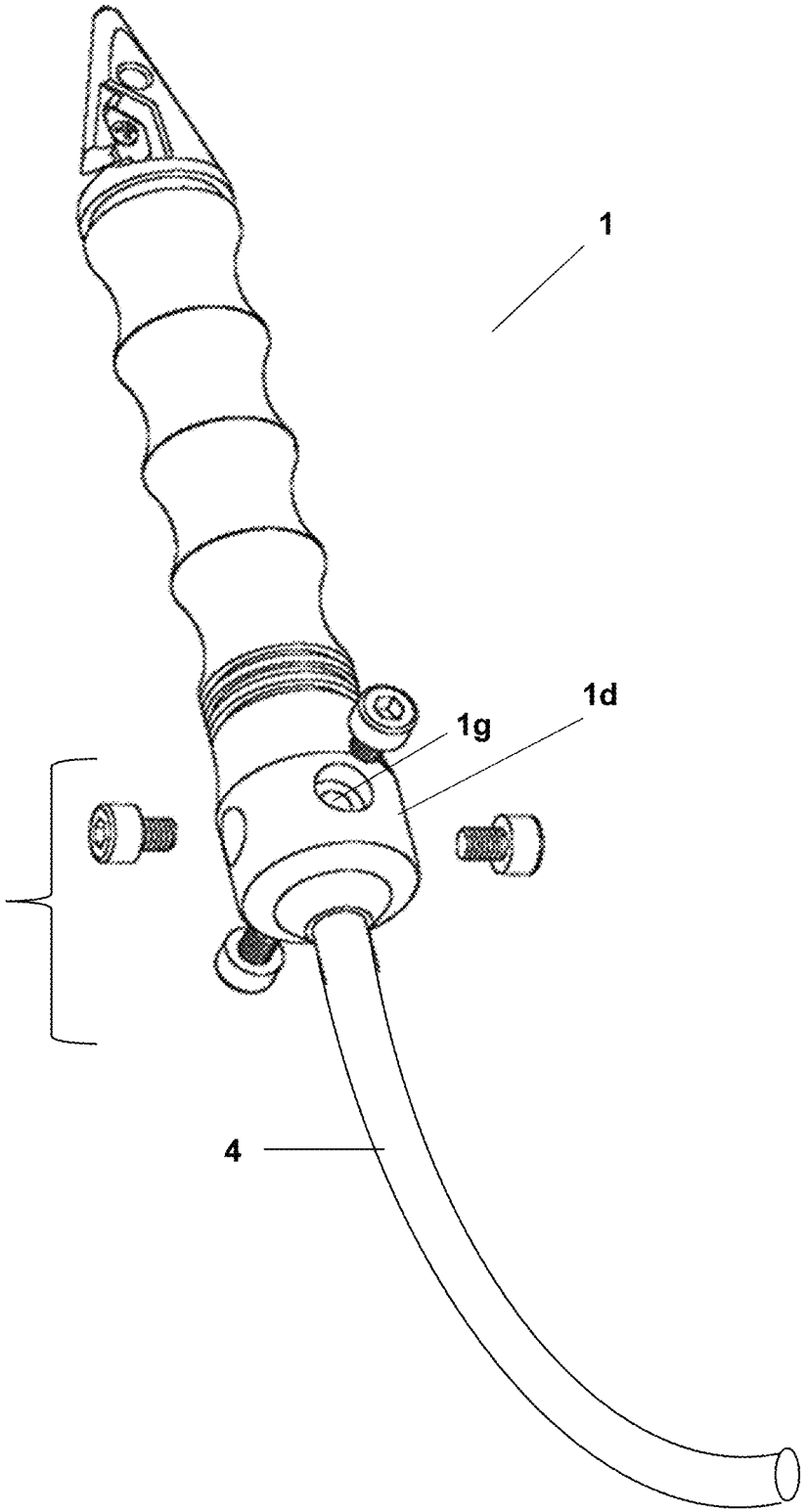

With continued reference to FIG. 5A, FIG. 5B shows the lash 4 inserted through the opening 1*f* into the lash receiving space 1*g*.

Figure 5C:
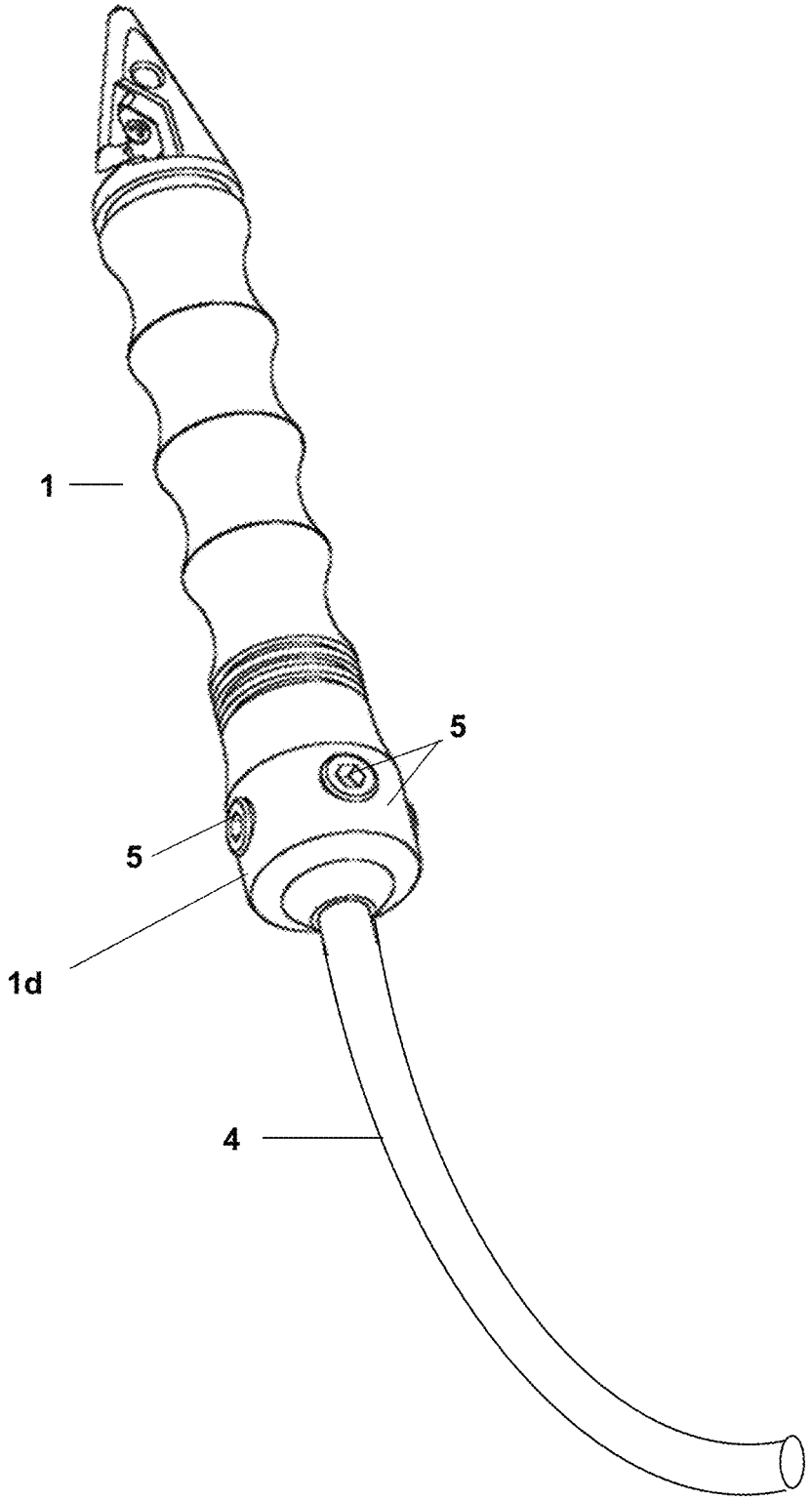

With continued reference to FIG. 5B, FIG. 5C shows the lash 4 inserted into the lash receiving space within the distal end 1*d* and secured with the plurality of screws 5. The tactical whip comprising the handgrip and the secured lash provides a tool that enables the user to non-lethally injure and ward off an attacker.

Figure 6:
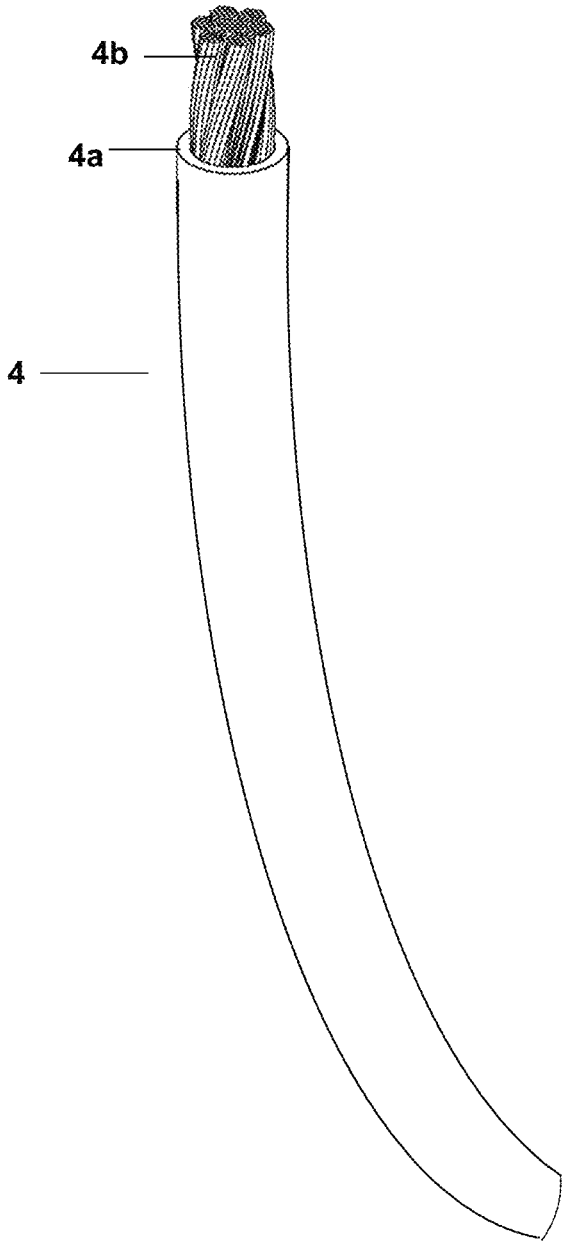
FIG. 6 is a cut-away view of the lash on the tactical whip showing a casing and the cable strands encased thereby.

FIG. 6 illustrates the structure of the lash 4 showing the flexible casing 4*a* and the flexible entwined strands 4*b* formed as a cable encased within the flexible casing.

The present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below.

What is claimed is:

1. A personal safety tool, consisting of:

a tool body consisting of:

a plurality of finger grips disposed on an outer surface thereof;

a collar formed at a proximal end thereof; and a lash receiving space formed interiorly within a distal end thereof, said distal end consisting of an opening formed into the lash receiving space at an end surface thereof and a plurality of openings formed circumferentially through the outer surface at the distal end into the lash receiving space;

a clip removably clipped around the collar on the tool body;

a window striker with a striker tip at a proximal end thereof formed at the collar on the tool body and a strap receiving opening disposed therethrough;

a hook-shaped structure formed on an outer surface of the window striker with a blade secured therewithin;

a lash consisting of a cable of flexible entwined strands and a flexible casing disposed therearound with a proximal end thereof received within the lash receiving space at the distal end of the tool body; and means for securing the proximal end of the lash within the lash receiving space via the plurality of openings formed circumferentially through the outer surface at the distal end.

2. The personal safety tool of claim 1, wherein the tool body is made of at least one material selected from the group consisting of a plastic, a plastic composite, a metal, a metal alloy, and a metal composite.

3. The personal safety tool of claim 1, wherein the striker tip is made of a metal or a metal alloy.

4. The personal safety tool of claim 1, wherein the lash comprises about 3 to about 6 flexible strands entwined in the cable.

5. The personal safety tool of claim 4, wherein the strands are each made of at least one material selected from the group consisting of a metal, a metal alloy, a metal composite, a plastic, a plastic composite, a leather, and a synthetic leather.

6. The personal safety tool of claim 5, wherein the strands are each made of steel.

7. The personal safety tool of claim 1, wherein the lash has a length from about 12 inches to about 24 inches.

8. A multifunctional safety tool, consisting of:

a tool body with an outer surface, a proximal end and a distal end;

said outer surface consisting of a plurality of finger grips disposed thereon;

said proximal end consisting of a window striker portion with a striker tip, a strap receiving opening therethrough, a collar, with a clip removably clipped thereon, formed immediately distal to the window striker portion and around the tool body and a hook-shaped structure formed on an outer surface thereof with a blade secured therewithin; and said distal end consisting of a lash securing portion with a lash receiving space formed therein with an opening at an end surface of the lash securing portion and a plurality of openings formed circumferentially through the outer surface on the lash securing portion, a lash, consisting of a cable of flexible entwined strands and a flexible casing disposed therearound, a proximal end of the lash received within the lash securing portion and a plurality of securing screws disposed within the plurality of openings formed circumferentially through the outer surface on the lash securing portion in a securing relationship with the proximal end of the lash.

9. The multifunctional safety tool of claim 8, wherein the striker tip is made of a metal or a metal alloy.

10. The multifunctional safety tool of claim 8, wherein the lash is about 3 to about 6 strands.

11. The multifunctional safety tool of claim 10, wherein the flexible strands are each made of steel.

12. The multifunctional safety tool of claim 8, wherein the lash has a length from about 12 inches to about 24 inches.

13. The multifunctional safety tool of claim 8, wherein the tool body is made of at least one material selected from the group consisting of a plastic, a plastic composite, a metal, a metal alloy, and a metal composite.

* * * * *